US006546745B2

(12) United States Patent
Torres et al.

(10) Patent No.: US 6,546,745 B2
(45) Date of Patent: Apr. 15, 2003

(54) COOLER SHADE COVER FOR EVAPORATIVE OR SWAMP COOLERS

(76) Inventors: Mary Ann Torres, 3715 S. Cedar Ave., Fresno, CA (US) 93725; Deborah Dean Stalker, 3715 S. Cedar Ave., Fresno, CA (US) 93725

( * ) Notice: Subject to any disclaimer, the term of this patent is extended or adjusted under 35 U.S.C. 154(b) by 0 days.

(21) Appl. No.: 09/931,536

(22) Filed: Aug. 17, 2001

(65) Prior Publication Data

US 2003/0037558 A1 Feb. 27, 2003

(51) Int. Cl.[7] ..... F25D 23/12; F25D 5/00
(52) U.S. Cl. ..... 62/259.1; 62/304
(58) Field of Search ..... 62/259.1, 304

(56) References Cited

U.S. PATENT DOCUMENTS

| | | | | | |
|---|---|---|---|---|---|
| 3,379,481 | A | * | 4/1968 | Fisher | 312/100 |
| 4,376,082 | A | * | 3/1983 | Heck | 165/135 |
| 4,498,912 | A | * | 2/1985 | Wagner | 261/29 |
| 4,768,350 | A | * | 9/1988 | Moran, Jr. | 312/100 |
| 4,838,038 | A | * | 6/1989 | Uecker et al. | 62/259.4 |
| 5,226,264 | A | * | 7/1993 | Walters | 135/137 |
| 6,158,175 | A | * | 12/2000 | Carter | 52/23 |

* cited by examiner

*Primary Examiner*—William C. Doerrler
*Assistant Examiner*—Filip Zec

(57) ABSTRACT

A simple one-piece, flexible, lightweight and portable shade apparatus for an evaporative or "swamp" cooler that can collapse for transport or storage and does not require tools or equipment for installation whereby it does not blemish or deface the cooler unit or the attached dwelling in any way.

7 Claims, 1 Drawing Sheet

COOLER SHADE COVER FOR EVAPORATIVE OR SWAMP COOLERS

CROSS-REFERENCE TO RELATED APPLICATIONS

U.S. Patent Documents

| | | | |
|---|---|---|---|
| 1289136 | December, 1918 | Elliott | 206/346 |
| 3353663 | February, 1966 | Kayser et al. | 206/346 |
| 3290020 | December, 1966 | C. A. Findley | 261/29 |
| 4376082 | March, 1983 | Heck | 261/127 |
| 4498912 | February, 1985 | Wagner | 55/486 |
| 4610292 | September, 1986 | Hausmann | 160/120 |
| 4732012 | March, 1988 | Thorpe | 62/304 |
| 4745769 | May, 1988 | Wooden Jr. | 62/259.1 |
| 4768350 | September, 1988 | Moran, Jr. | 62/DIG. 16 |
| 5889069 | March, 1999 | Suh et al. | 521/138 |
| 6014794 | January, 2000 | McCoy | 24/300 |
| 6161362 | December, 2000 | Forbis, Sr. et al. | 52/745.06 |

STATEMENT RECARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of Invention

This invention based on its one-piece flexible paneled composition, relates to a simple, portable, yet static, non-defacing shade apparatus for an evaporative cooler.

This invention requires no tools or equipment for installation and therefore is not of a permanently attached nature.

This invention due to its increased cooling effects on the cooler unit's enclosure will decrease the rate of evaporation of the water contained therein.

This invention will increase the decrease in temperature of the air discharged from an evaporative cooler. With the use of a thermostat or manually, this invention will assist in the decreased use of electrical energy when attainment of lower dwelling temperatures is reached.

2. Description of Prior Art

In our research we found there to be patents of similar function and yet with very different features of this invention as disclosed in U.S. Pat. Nos. 4,376,082, 4,498,912, 4,610,292, 4,732,012, 4,745,769, 4,768,350, and 6,161,362.

Material for use within the outer cover is based on U.S. Pat No. 5,889,069 or a similar product known for its heat resistant properties. This heat resistant material will be placed inside a pocket of the outer covering material and sealed at one end with a type material such as U.S. Pat. Nos. 1,289,136 and 3,353,663 for easy replacement of said heat resistant material if ever needed.

Previous shading apparatuses all require mechanical attachment and defacement of the evaporative cooler housing and or dwelling, as some are attached permanently to not only the top of the cooler unit but to the sides as well. Use of U.S. Pat No. 6,014,794 or similar type hooking device allows attachment without marring or defacing the cooling unit or dwelling while at the same time securing the shade apparatus to the unit. It also provides a means of installation requiring no tools and enhances the simplicity and portability of the shade apparatus.

This invention overcomes the prior art problems by providing a simple one-piece, lightweight, collapsible, portable, and especially non-defacing seasonal cooler shading apparatus that requires no tools for installation.

This invention also allows for maximum airflow below the shade and directly over the top of the cooling unit thereby increasing the insulative and cooling effects of this present invention over prior art forms.

BRIEF SUMMARY OF THE INVENTION

The object of this present invention is:

To provide a one piece, simple, easy to install and maintain, seasonal insulating shade apparatus for an evaporative or "swamp" cooler that requires no tools for installation, is very lightweight, collapsible and portable.

To provide an insulating shade apparatus that does not mar the cooling unit or a dwelling in any way.

To provide an insulating shade apparatus that allows for maximum airflow over the top as well as the sides of the evaporative cooling unit.

To provide an insulating shade apparatus for shading an evaporative or "swamp" cooler that is in use during the summer months.

To provide an insulating shade apparatus that keeps the ambient air temperature in the cooling unit lower, which in turn means a decrease in the rate of evaporation of water in the cooling unit.

To provide an insulating shade apparatus that increases the cooling efficiency of the cooler unit by keeping the external housing of the unit, cooler, thus decreasing the interior ambient air and thereby providing an additional decrease in the temperature of the air being discharged by the cooler unit.

To provide an insulating shade apparatus that will assist in the decrease of water consumption and the conservation of electrical energy after placement on the cooler unit.

To provide an insulating shade apparatus that can be manufactured for commercial as well as residential and window evaporative cooling units of all sizes. Variations of this insulating shade apparatus can be manufactured using cloth, harnesses or plastic injected outer covering to support the inner insulating material.

DETAILED DESCRIPTION OF THE PREFERRED EMBODIMENT

Figure 1:
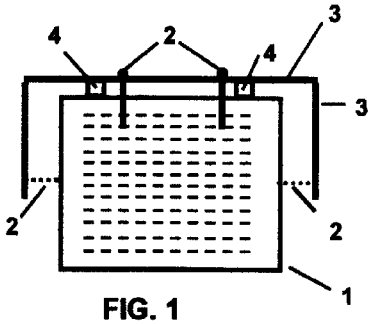
FIG. 1 is a perspective view of the present invention positioned on an evaporative or "swamp cooler.

FIG. 1 shows a perspective view of a conventional evaporative or "swamp" cooler 1 with the shade apparatus 3 of the present invention as it is positioned on the unit. This perspective view represents the north or south facing sides of the cooler unit 1. This present invention's placement is such that it will shade the cooling unit from early morning to late afternoon in the summer season when the sun emits the highest intense heat. This COOLER SHADE 3, as it will be know commercially, will also allow for maximum air flow between the shade apparatus 3, the top and sides of the evaporative cooler unit 1. An important point to note here is the open space between the COOLER SHADE 3, and the top of the cooler unit 1 due to the installation of lifters 4 which will be held in place with a type of Velcro material attached to the underside of the COOLER SHADE 3. By allowing airflow in this space, it not only provides for an increase in the insulative effects of the COOLER SHADE 3, it also does not allow heat to accumulate under the COOLER SHADE 3 and on top of the cooler unit 1, thereby increasing the efficiency of this COOLER SHADE 3 over prior art forms.

It will be observed that the COOLER SHADE 3 will extend beyond all sides of the cooling unit 1 so as to allow maximum airflow to sides of the unit and to provide an overhang in order to decrease the incidence of radiation reaching the cooling unit 1. Various sizes of this present invention will be manufactured to fit the different sizes of units varying from commercial units to residential and window units.

FIG. 1 also demonstrates the placement of the bungee cords (or elastic material attaching mechanisms) 2 and lifters 4. Materials that make up the composition of the shade apparatus 3 are demonstrated in FIG. 8.

Figure 2:
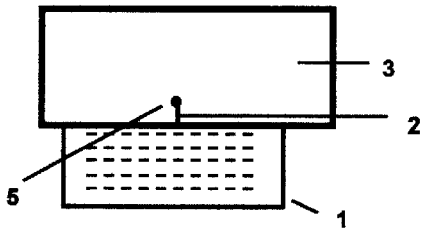
FIG. 2 is a side perspective view of the present invention positioned on an evaporative or "swamp" cooler.

FIG. 2 shows a perspective side view of a conventional evaporative or "swamp" cooler 1 with the cover apparatus 3 of the present invention as it is positioned on the unit. This perspective view represents the west facing side or the side of sunset in relationship to the placement of the cooler unit 1. This view also demonstrates the overhang of the COOLER SHADE 3 to the north and especially the south facing side of the cooler unit. The increased overhang of the COOLER SHADE 3 on the south side of the cooler unit 1 will provide sufficient shade to protect the unit from the overhead solar radiation without the need for additional materials as in prior art forms.

FIG. 2 also shows the placement where the side panel bungee cord or elastic material 2 will attach to the COOLER SHADE 3. The bungee cord 2 will be threaded through grommets 5. The grommets 5 will provide additional protection against tearing of the cloth or other material and the styrene.

Figure 3:
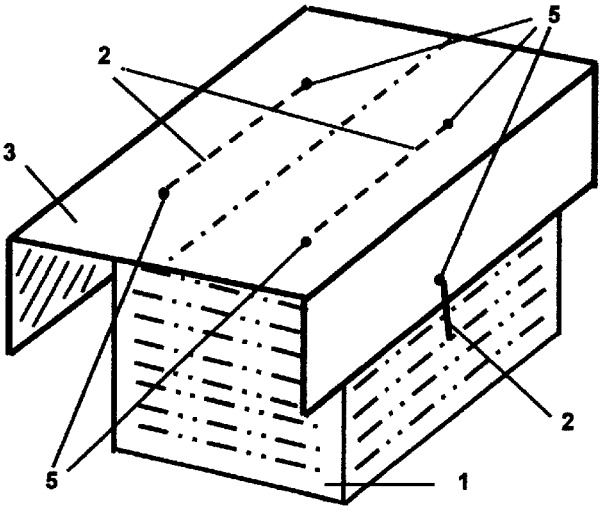
FIG. 3 is an aerial view of the present invention.

FIG. 3 illustrates an aerial view of the COOLER SHADE 3 of the present invention as it is positioned on top of the cooler unit 1. From this view you can see placement of the bungee cords or elastic material 2. The bungee cords or elastic material 2 will the threaded through and over the top of the COOLER SHADE 3. The plastic coated hooks of the bungee cords or elastic material 2 will be located underneath the COOLER SHADE 3 so they can be easily hooked or unhooked into the sides vents or louvers of the cooler unit. By installing the bungee cords or elastic material 2 in this fashion it will secure the COOLER SHADE 3 to the top of the cooler unit. The bungee cord or elastic material 2 attachments will provide sufficient strength to hold down the COOLER SHADE 3 to the top and sides of the cooler unit in the event of high winds. By attachment of the COOLER SHADE 3 with the use of the bungee cords or elastic material 2 there is no defacement or blemishes incurred to the cooler unit 1 or dwellings as in prior art forms.

Also displayed in FIG. 3 is the location of the grommets 5. The grommets 5 will provide additional protection against tearing of the cloth or other material and the styrene.

Figure 4:
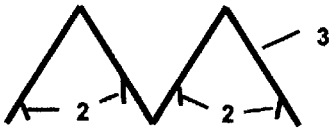
FIG. 4 is a perspective view of the present invention illustrating the ability to collapse for storage or transport.

FIG. 4 demonstrates the COOLER SHADE 3 as a one-piece flexible device that will be able to fold or collapse for storage, transport or shipping. Also displayed are the bungee cords or elastic material 2 that will remain attached when collapsing the COOLER SHADE 3.

Figure 5:
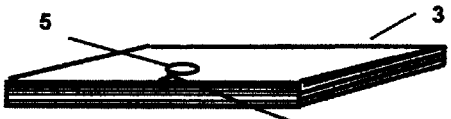
FIG. 5 is a view of the present invention collapsed.

FIG. 5 shows a completely collapsed COOLER SHADE 3. Also displayed is the location of the grommets 5 and bungee cord 2 on the side panel of the COOLER SHADE 3.

Figure 6:
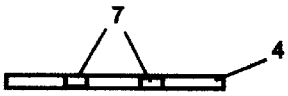
FIG. 6 is a view of the lifter that raises the present invention above the cooling unit and the attaching method used.

FIG. 6 displays the top view of a lifter 4. The lifters will consist of styrene, plastic, wood or other type of product, cut in lengths to fit atop of the different size cooling units 1. The lifter will lift the COOLER SHADE 3, above the cooler unit at least two to three inches to allow for maximum airflow above the unit. This airflow will increase the insulative effects of the COOLER SHADE 3 by not allowing trapped stagnant air to rest and heat the top of the unit as in prior art forms.

Also displayed in FIG. 6 are squares of Velcro 7 or similar type material. These squares will be used to attach the lifters to the underside of the COOLER SHADE 3. Additional security for holding the lifters 4 in place will be provided by the use of the top bungee cords or elastic material 2.

Figure 7:
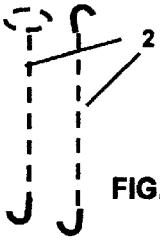
FIG. 7 is an expanded view of the type of attaching mechanisms with plastic coated hooks.

FIG. 7 displays the two styles of bungee cords or elastic stretch material 2 that will be used to attach the COOLER SHADE 3 to the cooler unit 1. One set will be used to secure the top panels of the COOLER SHADE 3 to the top of the cooler unit 1 by use of a set of plastic coated hooks at both ends that can be easily hooked and unhooked into the side vents or louvers of the cooler unit 1. The bungee cord 2 will be threaded through the two top grommets 5 and extending over the top of the COOLER SHADE 3. This type of attachment will provide sufficient security of the top panels to the cooler unit 1 against extreme wind velocities. The second set of bungee cords 2 will be used to secure the side panels of the COOLER SHADE 3. One end will be looped through the grommet 5 of the side panel while the opposite end of the bungee cord or elastic material 2 will be treaded through the loop and easily hooked or unhooked into the side vents or louvers of the cooling unit 1. This will allow for mini swinging action of the side panels in order to flow with a breeze of wind yet at the same time secure the panels against severe wind gusts. With the use of the bungee cord or an elastic stretch material attachment 2, no tools or equipment will be required for the installation of the COOLER SHADE 3, nor will there be any defacement or marring of the cooler unit 1 or dwelling as with other prior art forms.

Figure 8:
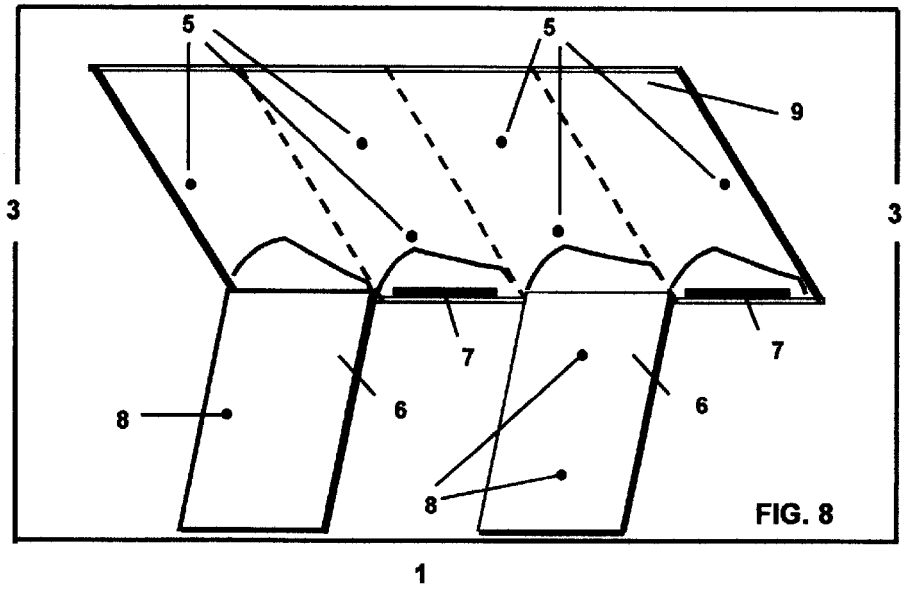
FIG. 8 is a perspective view of the present invention showing how the cloth or other material will be constructed and the placement for separating yet joining the insulating sheets.

FIG. 8 illustrates a perspective view of the composition of the present invention, the COOLER SHADE 3. Displayed is the outer cover material 9 with the pockets that will join the styrene sheets 6. Also displayed is the placement of the Velcro 7 type material that will be used to seal the one end of the pockets. This will allow for easy replacement of the styrene sheets should the need arise.

The composition of this present invention, the COOLER SHADE 3 as seen in FIG. 8, includes sheets of a type of high temperature, lightweight styrene polymer foam 6 or other type of lightweight insulative material. The styrene foam 6 has superlative insulating properties and provides for a higher R-value in relationship to its thickness. This insulative foam sheet 6 will be covered with a light reflective, water repellant type of cloth or material 9. The cloth or material 9 will be joined together as pockets and in such a way so as to slide one styrene sheet into each pocket of the cloth or material, thereby producing separate but joined panels of the COOLER SHADE 3. One end of the pocket will be sealed with a Velcro type material 7 so as to allow for replacement of the styrene if ever needed. The separate but joined panels of the COOLER SHADE 3 makes for a one-piece flexible unit that can fold and collapse onto itself. Variations of this model for the outer material can be constructed in a harness fashion or plastic injection molding and still allow for the styrene sheets 6 to be separate but joined.

FIG. 8 also demonstrates the placement of the grommets 5 and the corresponding openings 8 in the styrene sheets for placement of the bungee cords or elastic material.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

We claim as our invention:

1. A shade apparatus for an evaporative or "swamp" cooler constructed of a material that is seam sealed hinged in such a way as to allow for a four pocketed panel that is seam sealed hinged into a one-piece formation with a type of attachment at one end of each pocket panel for the easy opening and secure closing of said panel pockets, whereas the opening and closing of said panel pockets allows for the insertion of a rigid type material into the pocketed panel, with which the formation of the seam sealed hinged pocket panels of the material allows for the separate yet joined flexible panel pockets, which makes for two joined but separated top pocketed seam sealed panels and two joined but separated partial side pocketed seam sealed panels.

2. The shade apparatus of claim 1, in which the formation of the seam sealed hinged pocket panels of the outer material allows for the separate yet joined flexible panels, which make for the one-piece composition of the shade apparatus which in turn allows the shade apparatus to collapse on itself for storage purposes and or easy portability such as transport or shipping.

3. The shade apparatus of claim 1, where the end of the panel pockets will have a type of attachment for the easy opening and closing of each pocketed panel to allow for the insertion and or replacement of an inner insulating panel material if the need arises, whereas each seam sealed hinged pocket demonstrates a pocketed paneled section of the shade cover, and that each said separate panel pocket allows for the insertion of an inner rigid insulative panel with which the rigid material gives rigidity to the structure and that the inner material of said apparatus will provide insulative properties forming a thermal barrier, and that the outer seam sealed hinged material will be of a light reflective and water resistant nature.

4. The shade apparatus of claim 1 will be fastened to the cooler unit by use of a type of elastic material with hooks, providing manual attachment, detachment and reattachment that will require no tools for installation and making for a temporary shading structure, whereby the attaching method does not deface or mar the cooling unit or dwelling, and at the same time secures said shade apparatus to the cooling unit.

5. The shade apparatus of claim 1 will set on lifters that will attach under the top panels of the shade apparatus, allowing for maximum air flow over the top of the cooler unit thereby disallowing stagnant heated air to accumulate on top of said cooler unit.

6. The shade apparatus of claim 1 provides for a means of shading the cooler unit during the hours of intense daytime solar radiation.

7. The shade apparatus of claim 1 provides for a means of keeping the cooler unit's external housing cooler thereby decreasing the temperature of the internal ambient air and the air that is discharged, thus decreasing the rate of water evaporation within the unit and the amount of energy consumed.

* * * * *